United States Patent [19]

Keklak et al.

[11] Patent Number: 4,713,885

[45] Date of Patent: Dec. 22, 1987

[54] SAFE UTILITY KNIFE

[76] Inventors: Ronald Keklak, 637 Church St., Amston, Conn. 06231; Michael V. Couture, 228 Pine St., Holyoke, Mass. 01040; John C. Whitehouse, R.F.D. #1, Winsted, Conn. 06098

[21] Appl. No.: 939,004

[22] Filed: Dec. 8, 1986

[51] Int. Cl.[4] ..... B26B 1/08

[52] U.S. Cl. ..... 30/162; 30/2; 30/335

[58] Field of Search ..... 30/2, 66, 162, 163, 30/324, 335, 336; 81/363, 320, 371

[56] References Cited

U.S. PATENT DOCUMENTS 3,024,670 4/1962 Over et al. ..... 81/363 X

FOREIGN PATENT DOCUMENTS 316033 3/1934 Italy ..... 30/162

*Primary Examiner*—Douglas D. Watts

*Attorney, Agent, or Firm*—Kimmel, Crowell & Weaver

[57] ABSTRACT

A utility knife utilizing a standard commercial blade as a handle forming a guide for a blade slide and also serving as a housing for the blade in a retracted safe position. The blade slide is advanced and retracted by a toggle linkage connected with an operating lever pivotally attached to the handle and biased by a spring to a position causing automatic retraction of the blade into the housing when the lever is released. When the lever is grasped and pulled toward the handle for advancing the blade to a use position, the toggle linkage assumes a straight line dead center slide and blade locking position.

4 Claims, 5 Drawing Figures

SAFE UTILITY KNIFE

BACKGROUND OF THE INVENTION

1. Technical Field

This invention relates to an improved utility knife and more particularly relates to a knife in which the cutting blade is automatically retracted safely inside of the knife handle when an operating lever of the knife is released by the user.

2. The Prior Art

Most utility knives employing standard commercial cutting blades have the blade fixed in a use position and require positive action by the user to separate the blade from its carrier or handle, or to retract the blade when retraction means are provided. Such utility knives with exposed blades cannot be carried in the pocket or tethered to the user, since the exposed blade can cause damage or injury under these circumstances.

Utility knives are also known in which the blade is extended to a use position by cam action and is retracted by spring action to an enclosed position. These latter types of knives include no means other than the hand of the user to lock the blade in the extended use position and, consequently, forces on the blade during use, such as opening cartons, are transmitted to the hand. This is somewhat awkward and tends to render the knife unstable during use.

Therefore, a major object of the invention is to provide a safe utility knife including means cooperating with the hand of the user to lock the blade rigidly in the extended use position whereby forces on the blade are not felt by the hand of the user, and the knife is rigid and stable during heavy usage.

A further and more specific object of the invention is to provide a safe utility knife in which an extensible and retractable blade is operated by a simple toggle mechanism which assumes a straight line dead center blade locking position when the blade is extended for use, the toggle mechanism being connected with a hand lever pivotally attached to the knife handle.

Other features and advantages of the invention will become apparent to those skilled in the art during the course of the following detailed description.

SUMMARY OF THE INVENTION

The present invention is best summarized as a safe utility knife in which a cutting blade held on a slide having guided engagement with the knife handle is extended and retracted by a manually controlled toggle mechanism which assumes a blade locking straight line dead center position when the knife is in the extended use position. The blade is retracted automatically to a safe enclosed position inside of the handle when a spring-urged operating lever connected with the toggle mechanism is released by the hand of a user of the knife.

DETAILED DESCRIPTION

Figure 1:
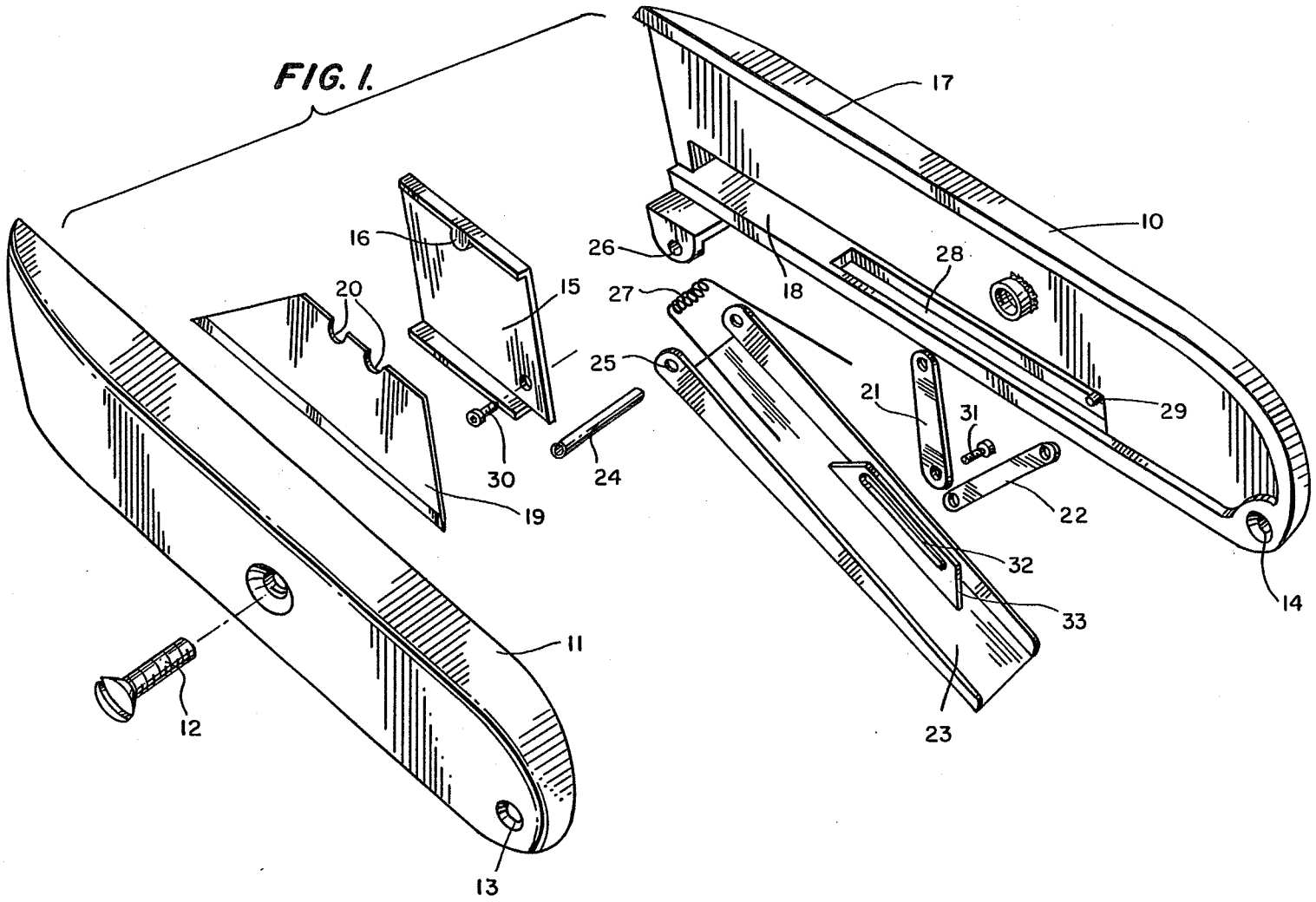
FIG. 1 is an exploded perspective view of a safe utility knife according to the present invention.
Figure 2:
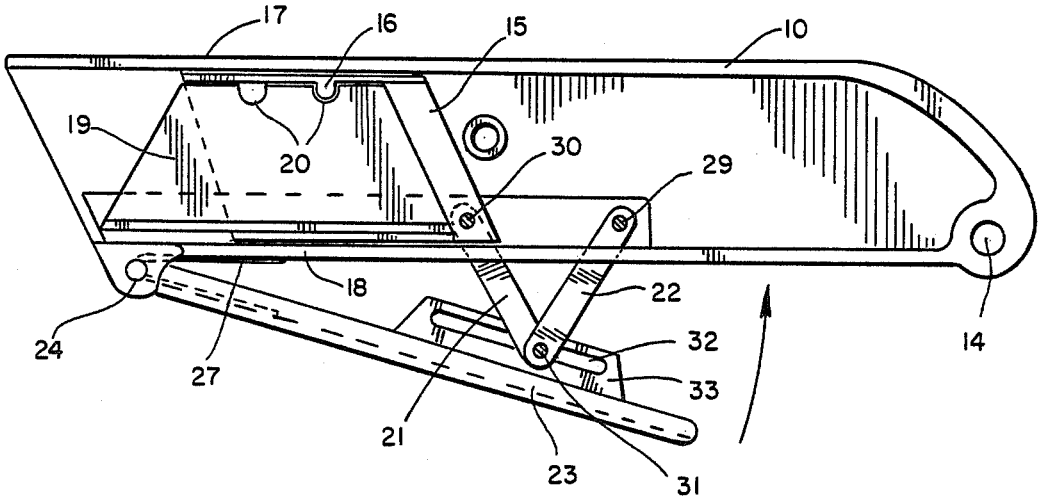
FIG. 2 is a side elevation of the knife showing the blade in an enclosed retracted safe position within the knife handle, one-half of which is removed for clarity of illustration.
Figure 3:
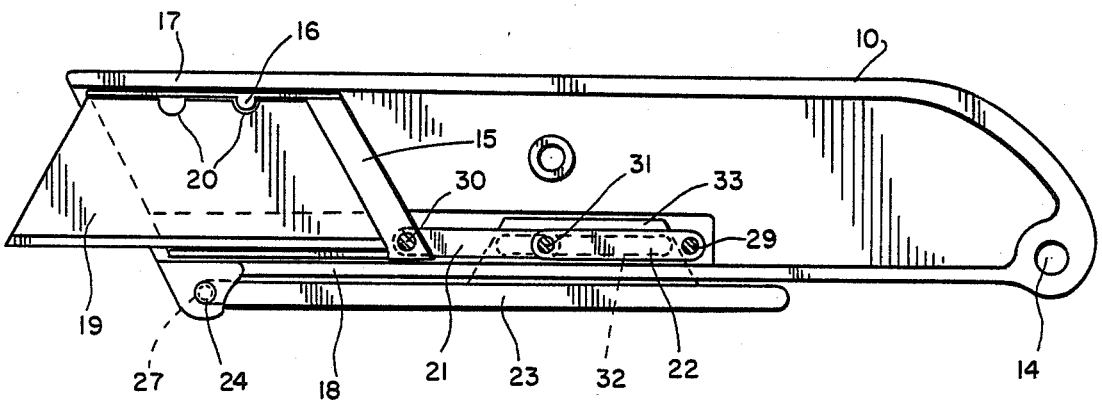
FIG. 3 is a similar view of the knife showing the blade in its extended use position.

Referring to the drawings in detail wherein like numerals designate like parts, a safe utility knife as depicted in FIGS. 1–3 includes an elongated handle consisting of two companion handle sections 10 and 11 joined in assembled relationshup by a screw 12 near the longitudinal center of the handle. A second screw or fastener, not shown, can be installed through apertures 13 and 14 to form a tether point at the rear of the handle sections 10 and 11.

A channel slide 15 having an internal lug 16 is slidably held in the knife handle in longitudinally guided engagement with two flanges 17 and 18 of the handle section 10. A standard commercial cutting blade 19 is held within the channel slide 15 and locked therein by interengagement of the lug 16 with one of the notches 20 of the blade 19. The forward end portion of the blade 19 extends forwardly of the slide 15, as shown in FIGS. 2 and 3.

A toggle mechanism including two straight apertured links 21 and 22 and an operating lever 23 is provided to control the movement of the slide 15 and blade 19 relative to the knife handle. The lever 23 is channel-like and has its forward end pivotally attached to the forward end of handle section 10 by a pivot pin 24 received in registering apertures 25 and 26 of the lever and handle. The lever 23 is constantly biased by a torsion spring 27 surrounding the pin 24 toward the position of FIG. 2 where the blade 19 is retracted safely inside of the handle, and the lever 23 is disposed at an acute angle to the handle.

The two links 21 and 22 are received movably through a longitudinal slot 28 in the flange 18. The rear end of link 22 is pivotally attached to a fixed pivot pin 29 on the handle section 10 near the rear end of the slot 28. The forward end of the link 21 is similarly pivotally attached to the rear lower corner of the slide 15 by a pin 30. Another pivot pin 31 pivotally interconnects the two links 21 and 22 at their respective rear and forward ends, and the pin 31 is engaged slidingly within a straight slot 32 formed in a bracket 33 fixed to the hand lever 23, and extending longitudinally thereof.

Whenever the hand lever 23 is released, the spring 27 moves it automatically to the angular position shown in FIG. 2, away from the knife handle. This movement collapses the toggle linkage involving the two links 21 and 22 which are pulled downwardly through the slot 28 to their positions in FIG. 2 where they extend below the knife handle. The collapsing of the toggle linkage automatically pulls the slide 15 and attached blade 19 safely inside of the handle 10–11 where the blade is fully enclosed and can cause no damage or injury.

When it is desired to use the blade 19 for opening a carton or the like, the user merely squeezes the lever 23 against the knife handle and the lever becomes parallel to the handle, FIG. 3. The toggle links 21 and 22 spread apart and assume straight longitudinal positions and, in so doing, the slide 15 and blade 19 are advanced so that the blade projects forwardly of the handle in the use position.

A unique feature of the invention is that, when the blade 19 is in the use position, the pivots 30, 31 and 29 of the toggle linkage are in a dead center relationship on a line parallel to the path of movement of the slide 15 and parallel to the handle. The three pivots are also on the center line of the camming slot 32. This enables the toggle linkage or mechanism to form a rigid lock for the slide and blade in the use position, FIG. 3, and forces acting on the blade 19 are transmitted to the dead center toggle linkage and are not transmitted to the hand of the user gripping the knife handle and lever 23. The only force felt by the hand is the force exerted by the spring 27.

When the lever 23 is released, the knife returns automatically to the safe configuration shown in FIG. 2.

Figure 4:
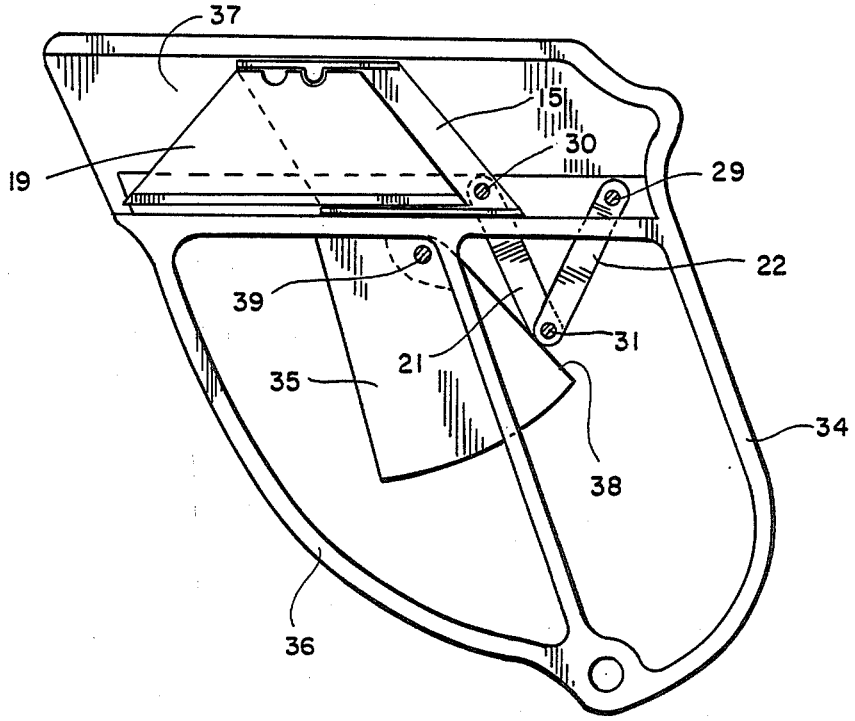
FIG. 4 is a side elevation of a safe utility knife showing a modified configuration of housing and hand grip.
Figure 5:
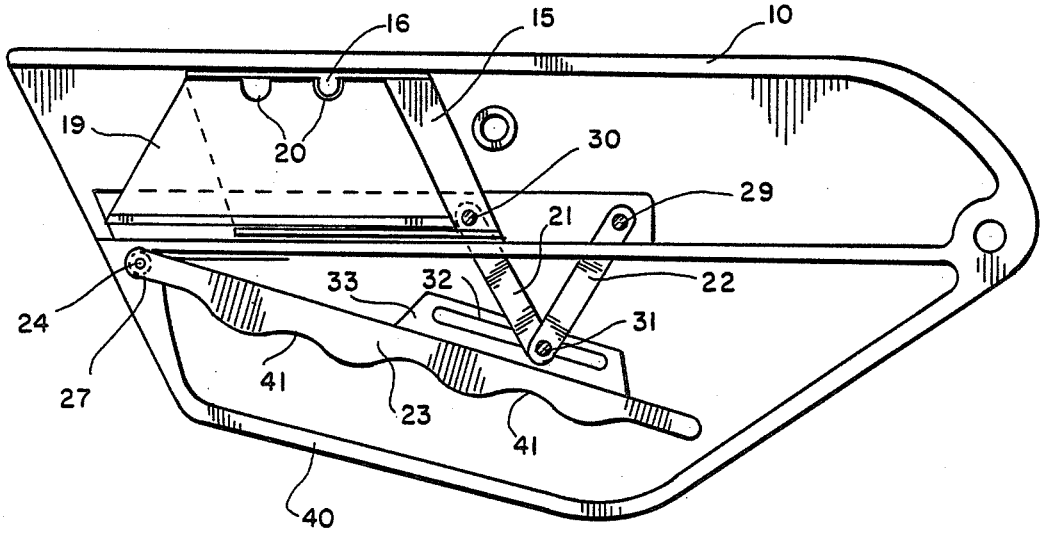
FIG. 5 is a similar view showing a further modified utility knife configuration according to the invention.

FIGS. 4 and 5 show two modified configurations for the safe utility knife according to the invention and the mode of operation of the knife remains basically unchanged in both of these modifications.

In FIG. 4, the safe utility knife is of pistol-like construction including a hand grip 34 and slide and blade operator in the form of a trigger 35 protected by a trigger guard 36. The slide 15 reciprocates in a guide channel 37 corresponding to the handle section 10 of the prior embodiment. The back edge 38 of the trigger 35 actuates the same toggle linkage composed of links 21 and 22 in the same manner previously described. The linkage is biased by a spring on one of the pivots to the position of FIG. 4, where the blade 19 is safely retracted and enclosed. The trigger 35 is pivotally attached to the structure by a pivot pin 39.

The trigger 35 is pulled rearwardly to expand the toggle linkage and extend the blade 19 outside of its enclosure 37 essentially in the manner described relative to FIG. 3.

In the configuration of FIG. 5, the construction is substantially as described for the embodiment of FIGS. 1–3. The principal difference is the provision of a guard 40 for a hand grip lever 23' which differs from the lever 23 in that it is provided with finger recesses 41. The mode of operation of the device in FIG. 5 is as described for the first embodiment of FIGS. 1–3.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A safe utility knife comprising a handle body portion having a linear guideway, a blade slide and blade mounted for movement in the linear guideway and being shiftable therein between a blade enclosed non-use position to a blade extended use position where the blade projects outside of said guideway, and a toggle mechanism including a pair of toggle links connected between said blade slide and guideway and a lever pivoted to the guideway and having a lost motion connection with said toggle links, means biasing the toggle mechanism in a direction maintaining said blade in the enclosed non-use position, and the handle body portion having substantially a pistol configuration including a hand grip, and said lever being in the form of a trigger at the forward side of the hand grip.

2. A safe utility knife comprising a handle body portion having a linear guideway, a blade slide and blade mounted for movement in the linear guideway and being shiftable therein between a blade enclosed non-use position to a blade extended use position where the blade projects outside of said guideway, and a toggle mechanism including a pair of toggle links connected between said blade slide and guideway and a lever pivoted to the guideway and having a lost motion connection with said toggle links, means biasing the toggle mechanism in a direction maintaining said blade in the enclosed non-use position, the handle body portion comprising a substantially straight elongated body portion, said lever being pivoted to the body near corresponding ends of the lever and body portion and the lever extending longitudinally of the body portion for a major portion of its length, and a guard for said lever connected between opposite ends of said substantially straight elongated body portion.

3. A safe utility knife comprising a handle body portion having a linear guideway, a reciprocatory blade slide adapted to mount a standard cutting blade within said guideway, a pair of pivoted toggle links connected between the blade slide and handle body portion, the handle body portion having a longitudinal slot within which said toggle links operate when moving between collapsed and extended straight line dead center positions, an operating lever pivotally connected to the handle body portion and having a slotted lost motion connection with an intermediate pivot element connecting said toggle links, and a biasing spring connected with said lever biasing it away from the handle body portion and biasing said toggle links toward said collapsed position and biasing said blade slide toward a fully enclosed non-use position inside of said handle body portion.

4. A safe utility knife as defined in claim 3, and one of said toggle links being pivotally attached to a rear corner of the blade slide near one guide surface of said linear guideway, and the other toggle link being pivotally attached to said body portion rearwardly of said slide and near said one guide surface, whereby said toggle links are close to, parallel with and extending longitudinally of said one guide surface when in the extended straight line dead center positions.

* * * * *